US005772034A

United States Patent [19]

Lin

[11] Patent Number: 5,772,034

[45] Date of Patent: Jun. 30, 1998

[54] BAG ASSEMBLY

[76] Inventor: Chih-Jen Lin, No. 9, Lane 42, Te-Ming Rd., Hsi Dist., Chia-Yi City, Taiwan

[21] Appl. No.: 892,700

[22] Filed: Jul. 15, 1997

[51] Int. Cl.[6] ..... B65D 81/20

[52] U.S. Cl. ..... 206/522; 206/524.8; 383/3; 383/43; 383/90

[58] Field of Search ..... 206/522, 524.8; 220/203.17; 383/43–49, 51–53, 58, 90, 3

[56] References Cited

U.S. PATENT DOCUMENTS

| | | | |
|---|---|---|---|
| 4,206,870 | 6/1980 | DeVries | 220/203.17 |
| 4,872,558 | 10/1989 | Pharo | 206/552 |
| 5,178,281 | 1/1993 | Enzu | 206/522 |
| 5,240,112 | 8/1993 | Newburger | 206/524.8 |
| 5,308,163 | 5/1994 | Abe | 383/44 |
| 5,447,235 | 9/1995 | Pharo | 206/522 |
| 5,588,532 | 12/1996 | Pharo | 206/522 |

FOREIGN PATENT DOCUMENTS

| | | | |
|---|---|---|---|
| 2218401 | 11/1989 | United Kingdom | 206/522 |

*Primary Examiner*—Jimmy G. Foster
*Attorney, Agent, or Firm*—Renner, Otto, Boisselle & Sklar, P.L.L.

[57] ABSTRACT

A bag assembly includes a bag body and a valve unit. The bag body confines a receiving space and is formed with a vent hole. The valve unit is provided in the vent hole and includes an upper sheet and a lower sheet which are heat-sealed to the bag body and which cooperatively confine an air passage that is communicated with the receiving space. The upper and lower sheets of the valve unit have opposing inner surfaces which are electrostatically charged such that the upper and lower sheets normally adhere to each other via an electrostatic attraction at the inner surfaces thereof, thereby closing the air passage of the valve unit.

5 Claims, 4 Drawing Sheets

BAG ASSEMBLY

BACKGROUND OF THE INVENTION

1. Field of the Invention

The present invention relates to a bag assembly, more particularly to one having a valve unit with electrostatically charged inner surfaces for automatic closure so as to prevent passage of air therethrough.

2. Description of the Related Art

A vacuum container is available in the art to prevent ease of mildewing of objects and to prolong the useful life of the same. A conventional vacuum container includes a main body which confines a receiving space with an opening and which is provided with a vent valve that can be connected to a vacuuming device for vacuuming the receiving space of the main body. In use, the opening is closed after an object is received in the main body, and the vent valve is connected to the vacuuming device which is then actuated to vacuum the receiving space. Although the vacuum container can prevent ease of mildewing of the object received therein so as to prolong the useful life of the latter, it is noted that the vent valve has a relatively complicated structure and is not easy to operate. An auxiliary device is usually needed for operating the vent valve. The aforementioned vacuum container is thus not convenient both in manufacturing and in use.

A cushioning bag having a structure similar to that of the aforementioned vacuum container has been developed for protecting an object during transport. The cushioning bag includes two adjacent bag bodies which are in fluid communication with each other, and a valve unit mounted on one of the bag bodies. The valve unit includes a pair of opposing flexible sheets that confine an air port through which air can be blown into the bag bodies to inflate the latter, thereby embracing an object disposed between the bag bodies so as to isolate the object from external shock. However, the cushioning bag has a drawback in that the flexible sheets tend to move away from each other when pressure is applied on the inflated bag bodies, thereby resulting in opening of the air port of the valve unit. Thus, the aforementioned cushioning bag is not satisfactory since the valve unit can not close effectively the bag bodies.

SUMMARY OF THE INVENTION

The main object of the present invention is to provide a bag assembly which has an automatically closable valve unit and which is easy to operate.

Accordingly, the bag assembly of the present invention includes a bag body and a valve unit. The bag body confines a receiving space and is formed with a vent hole. The valve unit is provided in the vent hole, and includes an upper sheet and a lower sheet which are heat-sealed to the bag body and which cooperatively confine an air passage that is communicated with the receiving space. The upper and lower sheets have opposing inner surfaces which are electrostatically charged such that the upper and lower sheets normally adhere to each other via an electrostatic attraction at the inner surfaces thereof, thereby closing the air passage of the valve unit.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
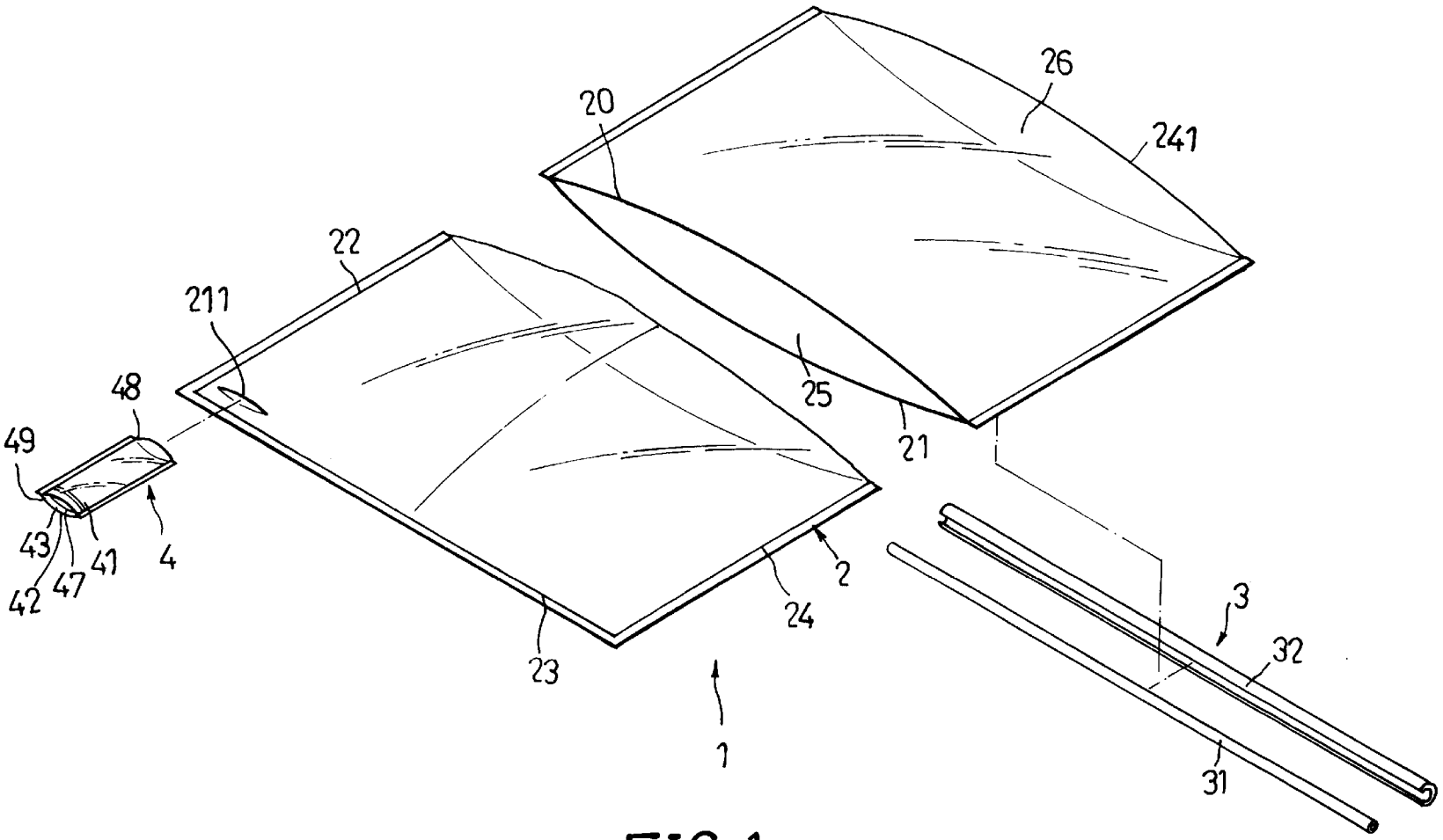
FIG. 1 is an exploded perspective view of a bag assembly according to a first preferred embodiment of the present invention.
Figure 2:
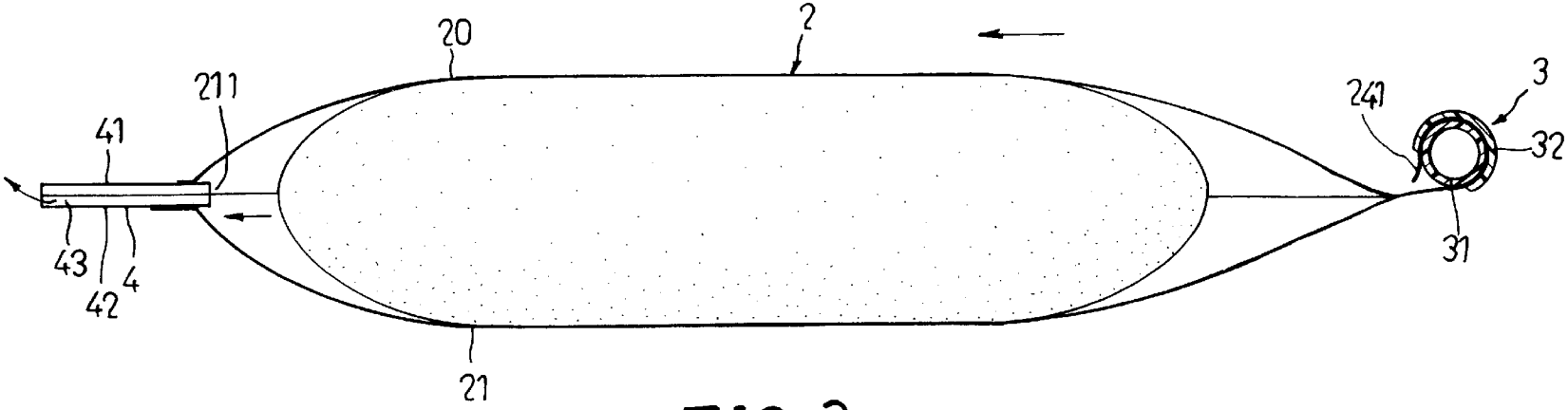
FIG. 2 is a side view of the bag assembly of FIG. 1 when in use.

Referring to FIGS. 1 and 2, the bag assembly 1 according to the first preferred embodiment of this invention is shown to include a bag body 2, a closure unit 3 and a valve unit 4.

The bag body 2 is made of a flexible sheet material, and includes a first sheet 20 superimposed on a second sheet 21 and having a size substantially the same as that of the second sheet 21. The first and second sheets 20, 21 are substantially rectangular in shape and are joined at first, second and third edge portions 22, 23, 24 by means of a heat-sealing technique. The first and second sheets 20, 21 further have fourth edge portions 241 that define an opening 26, thereby resulting in a receiving space 25 with an open end. The first sheet 20 is formed with a vent hole 211 adjacent to the second edge portion 23.

The closure unit 3 is used to close the opening 26 and includes an elongated rod 31 which permits winding of the fourth edge portions 241 of the first and second sheets 20, 21 thereon, and an elongated sleeve 32 with a C-shaped cross-section for sleeving on the rod 31. The rod 31 and the sleeve 32 are at least equal in length to the fourth edge portions 241 of the sheets 20, 21.

Figure 3:
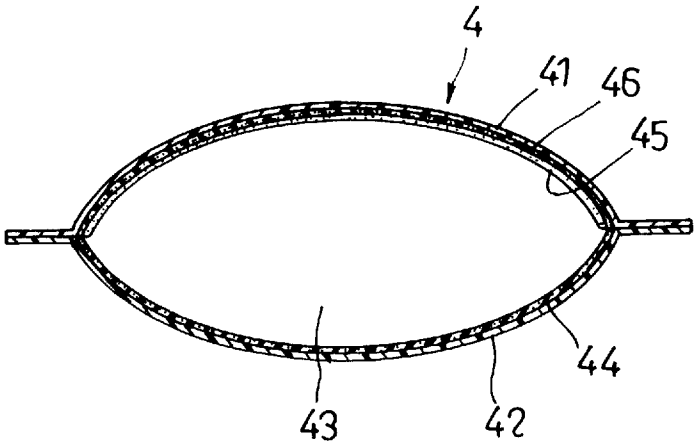
FIG. 3 is an enlarged cross-sectional view of a valve unit of the bag assembly of FIG. 1.

Referring to FIGS. 1 and 3, the valve unit 4 is provided in the vent hole 211, and has an upper sheet 41 and a lower sheet 42 which are made of an air-impermeable flexible sheet material and which have opposite lateral edge portions that are heat-sealed to each other. The valve unit 4 further has a first end portion 48 which extends into the vent hole 211 and which is heat-sealed to the first sheet 20 at the vent hole 211. The upper and lower sheets 41, 42 cooperatively confine an air passage 43 that is communicated with the receiving space 25 of the bag body 2. The upper and lower sheets 41, 42 of the valve unit 4 have opposing inner surfaces 44 which are electrostatically charged by rubbing the inner surfaces 44 with a dielectric object. Therefore, the upper and lower sheets 41, 42 can normally adhere to each other via an electrostatic attraction at the inner surfaces 44 thereof, thereby closing the air passage 43 of the valve unit 4. The inner surfaces 44 of the upper and lower sheets 41, 42 are further provided with a layer of an epoxy resin 46 to result in increased adhesion between the upper and lower sheets 41, 42 of the valve unit 4. In addition, the inner surface 44 of the upper sheet 41 is further provided with a heat resistant oil-based coating 45 at the first end portion 48. The oil-based coating 45 is not fusible at a fusing temperature of the sheets 41, 42 and thus, is not cemented to the lower sheet 42 during a heat-sealing process, thereby preventing the upper and lower sheets 41, 42 from bonding to one another. The oil-based coating 45 also serves to enhance the air-tight relationship between the upper and lower sheets 41, 42. As shown in FIG. 1, the valve unit 4 has a second end portion 49 opposite to the first end portion 48 and provided with a closure unit 47, which is in the form of complementary sealing strips formed on the upper and lower sheets 41, 42, for closing the second end portion 49.

Figure 4:
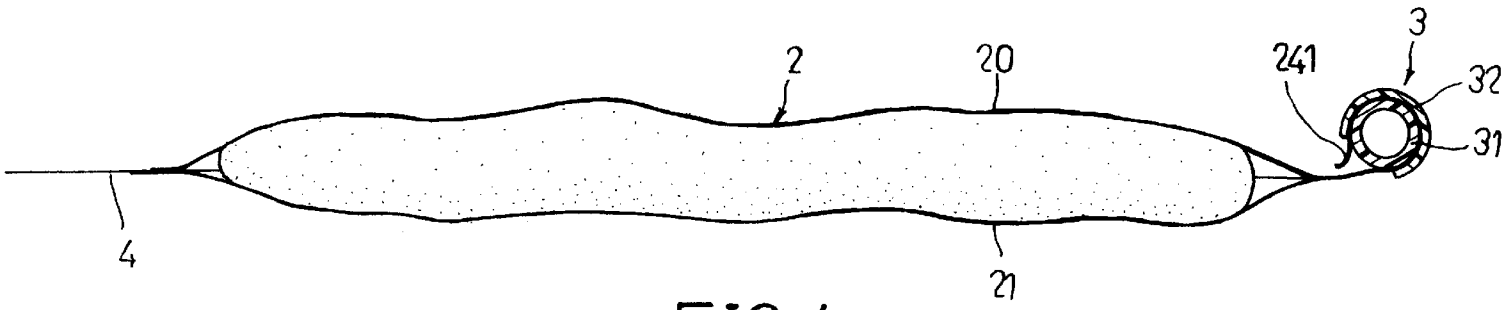
FIG. 4 is a side view of the bag assembly of FIG. 1 after air has been discharged therefrom.

Referring to FIGS. 1 and 2, in use, an object is placed in the receiving space 25 via the opening 26 of the bag body 2. The fourth edge portions 241 are then wound around the rod 31, which, in turn, is sleeved by the sleeve 32 so as to close the opening 26. Air is then discharged through the air passage 43 of the valve unit 4 either by applying pressure to the bag body 2 or by rolling the closure unit 3 in a direction from the fourth edge portions 241 toward the second edge portions 23 of the bag body 2. Referring to FIGS. 3 and 4, when air is discharged from the bag body 2, the bag body 2 is simultaneously compressed. In this situation, the upper and lower sheets 41, 42 of the valve unit 4 can adhere to each other by virtue of the electrostatic attraction at the inner surfaces 44 thereof and with the assistance of the layer of epoxy resin 46 on the inner surfaces 44. Accordingly, the discharge of air from the bag assembly 1 of the present invention can be easily conducted without the need for an auxiliary device. Finally, the closure unit 47 provided on the second end portion 49 of the valve unit is closed to ensure that the bag body 2 remains in a compressed state for a long period of time.

Referring again to FIG. 1, it should be noted that the closure unit 3 for closing the opening 26 of the bag body 2 is not limited to the combination of the elongated rod 31 and the elongated sleeve 32 as in the present embodiment. The opening 26 may also be closed by heat-sealing the fourth edge portions 241 of the first and second sheets 20, 21 of the bag body 2 by means of a heating device, such as a press iron.

Figure 5:
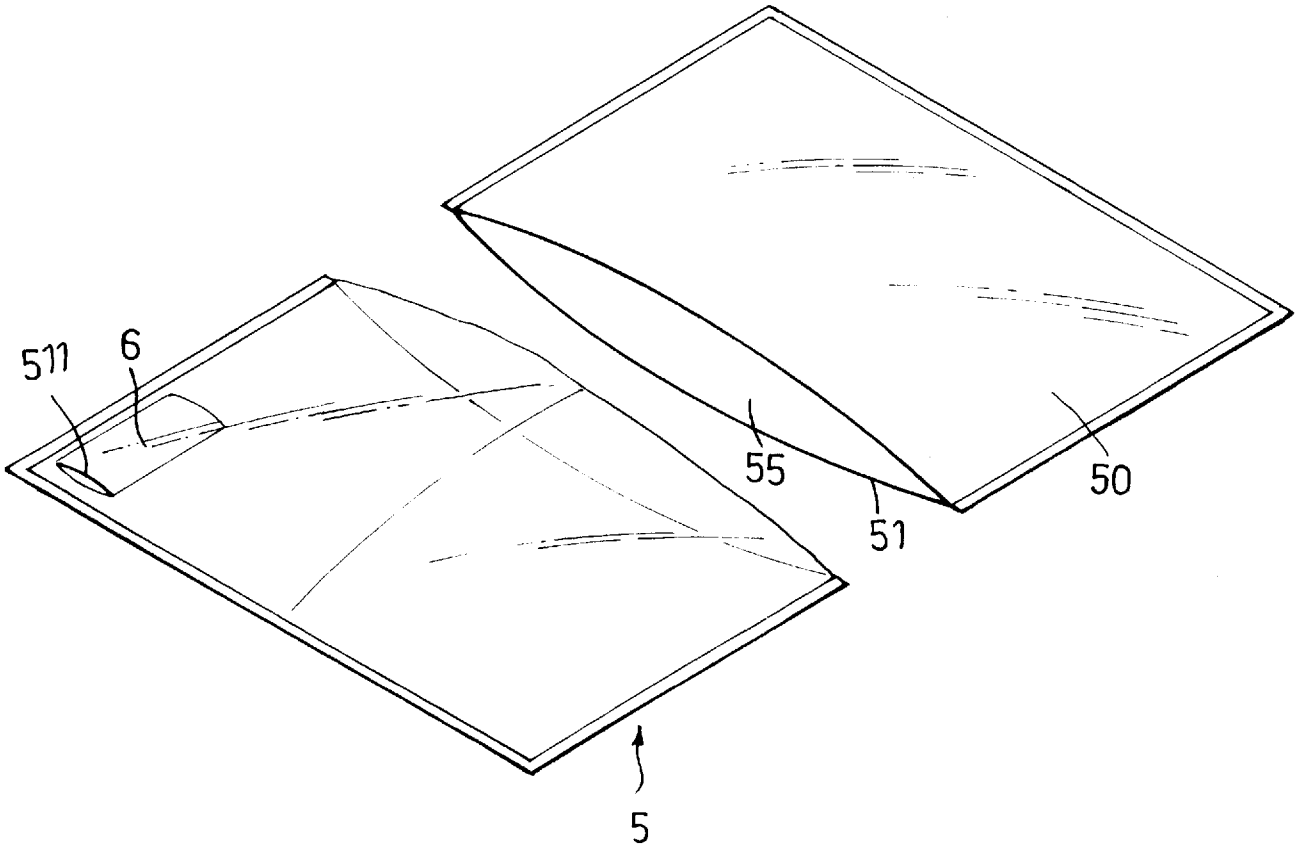
FIG. 5 is perspective view of a bag assembly of according to a second preferred embodiment of the present invention.

Referring to FIG. 5, the bag assembly can be used as a cushioning bag in a second preferred embodiment of this invention. As shown, the bag assembly of this embodiment comprises a bag body 5 and a valve unit 6. The bag body 5 includes first and second sheets 50, 51 which are rectangular in shape and which are heat-sealed to each other at four edge portions thereof, thereby confining a closed air chamber 55 in the bag body 5. The first sheet 50 is formed with a vent hole 511 for mounting the valve unit 6, which is similar in structure to the valve unit 4 of the previous embodiment. The valve unit 6 has a first end portion extending into the air chamber 55 via the vent hole 511, and a second end portion located at the vent hole 511.

In use, air is charged into the air chamber 55 via the valve unit 6 to inflate the bag body 5. After the bag body 5 is inflated, the valve unit 6 can be closed by the pressure of the air received in the air chamber 55. The bag assembly is thus ready for use as a cushioning bag. It should be noted that, when pressure is subsequently applied on the bag body 5 from an exterior thereof, the pressure applied on the valve unit 6 will be increased further to close the valve unit 6 rather than open the same. The bag assembly is thus superior to the aforementioned conventional cushioning bag.

With this invention thus explained, it is apparent that numerous modifications and variations can be made without departing from the scope and spirit of this invention. It is therefore intended that this invention be limited only as indicated in the appended claims.

I claim:

1. A bag assembly comprising:

a bag body confining a receiving space and being formed with a vent hole; and a valve unit provided in said vent hole of said bag body, said valve unit including an upper sheet and a lower sheet which are heat-sealed to said bag body and which cooperatively confine an air passage that is communicated with said receiving space, said upper and lower sheets having opposing inner surfaces which are electrostatically charged such that said upper and lower sheets normally adhere to each other via an electrostatic attraction at said inner surfaces thereof, thereby closing said air passage of said valve unit.

2. The bag assembly according to claim 1, wherein said valve unit has a first end portion extending into said vent hole of said bag body and heat-sealed to said bag body, said inner surface of at least one of said upper and lower sheets being further provided with a heat-resistant coating at said first end portion to prevent said upper sheet from being heat-sealed to said lower sheet at said first end portion during a heat-sealing process.

3. The bag assembly according to claim 2, wherein said valve unit further has a second end portion which is opposite to said first end portion and which is provided with a closure unit for closing said second end portion.

4. The bag assembly according to claim 1, wherein said bag body is formed with an opening opposite to said valve unit to serve as an access into said receiving chamber, said bag assembly further comprising a closure unit for closing said opening.

5. The bag assembly according to claim 1, wherein said inner surfaces of said upper and lower sheets of said valve unit are provided with a layer of epoxy resin.

* * * * *